United States Patent [19]

Bonin

[11] 4,050,193

[45] Sept. 27, 1977

[54] GRINDING HEAD FOR MACHINING CONSTANT INTERNAL PROFILES

[75] Inventor: Jean Claude Bonin, Blois, France

[73] Assignee: Roto Diesel, Blois, France

[21] Appl. No.: 647,044

[22] Filed: Jan. 7, 1976

[30] Foreign Application Priority Data

Jan. 10, 1975 France ..... 75.00672

[51] Int. Cl.[2] ..... B24B 17/02

[52] U.S. Cl. ..... 51/101 R; 51/165.87

[58] Field of Search ..... 51/5 D, 101 R, 165.87, 51/165.88, 165.89, 127; 74/569; 90/13.4

[56] References Cited

U.S. PATENT DOCUMENTS

| | | | |
|---|---|---|---|
| 2,637,950 | 5/1953 | Norsworthy | 51/165.87 X |
| 3,750,345 | 8/1973 | Kolesar | 51/101 R |
| 3,828,481 | 8/1974 | Uhtenwoldt | 51/101 R |
| 3,834,084 | 9/1974 | Sakane | 51/101 R |

*Primary Examiner*—Al Lawrence Smith
*Assistant Examiner*—Nicholas P. Godici

[57] ABSTRACT

A grinding head for machining the internal surface of a ring member includes a rotary grinding wheel which is coupled to a detector roll which can be moved about the internal surface of a master ring. The detector roll is tapered so that as the grinding wheel wears the detector roll can be moved axially to adjust its effective diameter to correspond to the diameter of the grinding wheel.

10 Claims, 6 Drawing Figures

GRINDING HEAD FOR MACHINING CONSTANT INTERNAL PROFILES

The invention relates to a grinding head for attachment to a grinding machine for machining internal profiles, with high precision and high reproducibility characteristics, starting from a generator profile or mastercam.

Grinding heads are known for machining internal profiles using a master cam. Following progressive diamond dressing to re-shape the grinding wheel and adjust its geometry, the wheel diameter is reduced and the profile as obtained is considerably modified. As a result, when tolerances are narrow, the same wheel can only be used for a limited number of grinding passes, and profiles obtained with the same wheel are different. This consequently involves a high consumption of wheels and increasing lost time due to frequent wheel-changes.

The object of the invention is to provide a grinding head in a simple and convenient form.

According to the invention a grinding head for machining constant internal profiles comprises a wheel rotatable about its own axis, a generator profile subordinates so as to remain in contact with a detector roll as it moves relatively to the said detector roll, and means to impart to the machined component and as related to the grinding wheel, a movement which is homothetic with the movement of the generator profile as related to the detector roll, said grinding head being characterised by the fact that the detector head is of variable diameter, the said diameter being subordinated to the diameter of the grinding-wheel so as to remain in constant ratio with it, after each dressing of the wheel.

For that purpose, the object of the invention is a grinding head for machining constant internal profiles, of the type comprising a grinding wheel rotating about its own axis, a generator profile arranged to remain in contact with a detector roll and moving relatively to the said detector roll, and means whereby the component to be machined is propelled in a manner related to the wheel which is homothetic to the generator profile movement as related to the detector roll, the grinding head being characterised by the fact that the said detector roll has a variable diameter, the said diameter being controlled by the wheel diameter in such a manner as to maintain a constant ratio with it after each wheel-dressing operation.

In this manner, the changes in grinding wheel diameter after each dressing operation and geometrical adjustment, are automatically communicated to the detector roll in such a manner as to maintain the reproduction precision.

In a preferred design form, the said detector roll is a taper roll mounted on the one hand, to rotate on a shaft in such a manner that one of its generator lines remains parallel with the rotation axis of the grinding-wheel, and on the other hand so that it can move parallel to the said generator line.

The contact curve for such a taper roll upon the generator profile is an ellipse which, following suitable choice of the taper and bearing in mind the amplitude of variations in the generator profile, may be assimilated to a circle.

The invention is more easily understood by reference to the following description and the appended drawing wherein.

Figure 1:
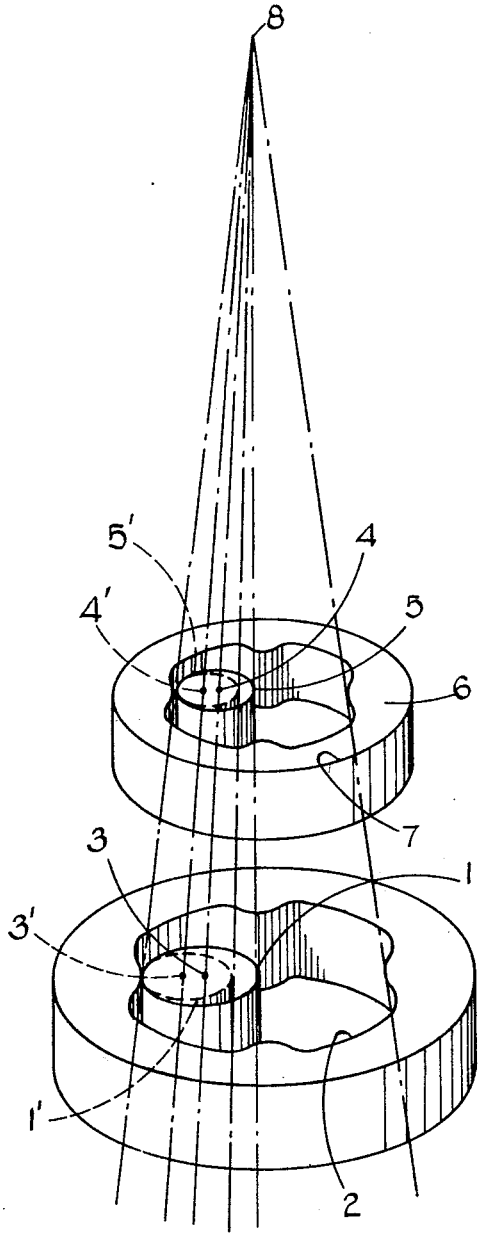
FIG. 1 is a perspective view showing a sketch of a grinding head.

Reference is first made to FIG. 1. A detector roll 1 follows a generator profile 2 defined on a master cam and the centre 3 of the roll is maintained in line with the centre 4 of a rotary grinding wheel 5 machining a component 6, so that the profile which is being ground 7 corresponds to the profile 2.

Where as a result of wheel-dressing and geometric adjustment, the grinding wheel diameter is reduced, but the centres 3 and 4 remain in line there will be a change in the ground profile 7.

The apparatus to be described provides for the diameter of the detector roll 1 to be related to the diameter of the wheel 5, in order to maintain a constant ratio between the diameters after each dressing operation. As an example, when the grinding-wheel reaches the form 5' shown in dotted line in FIG. 1, the detector roll 3 assumes the shape 1' shown in dotted line, the centres 3' and 4' forming a straight line passing through the homothetic centre 8, so that an homothetic condition is maintained and the ground profile remains constant.

Figure 2:
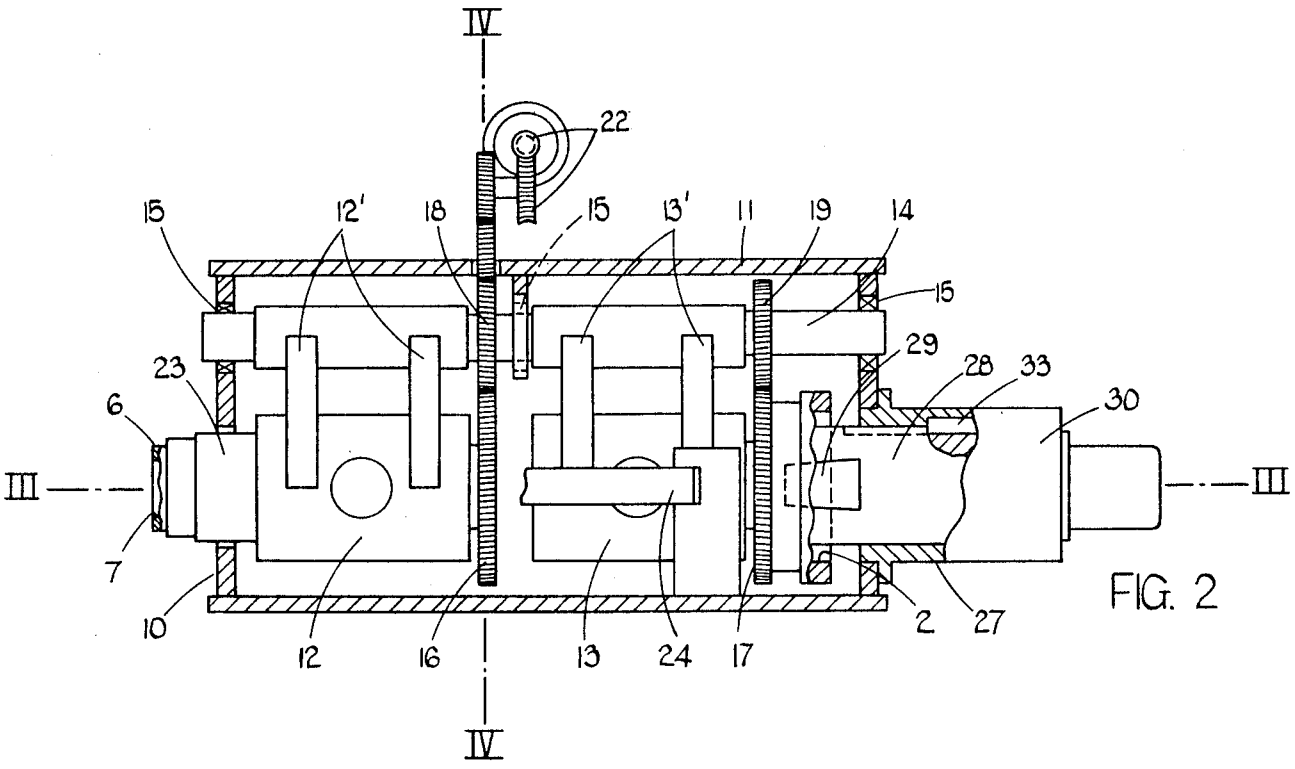
FIG. 2 is a simplified vertical section through a grinding machine comprising a grinding head according to an invention design.
Figure 3:
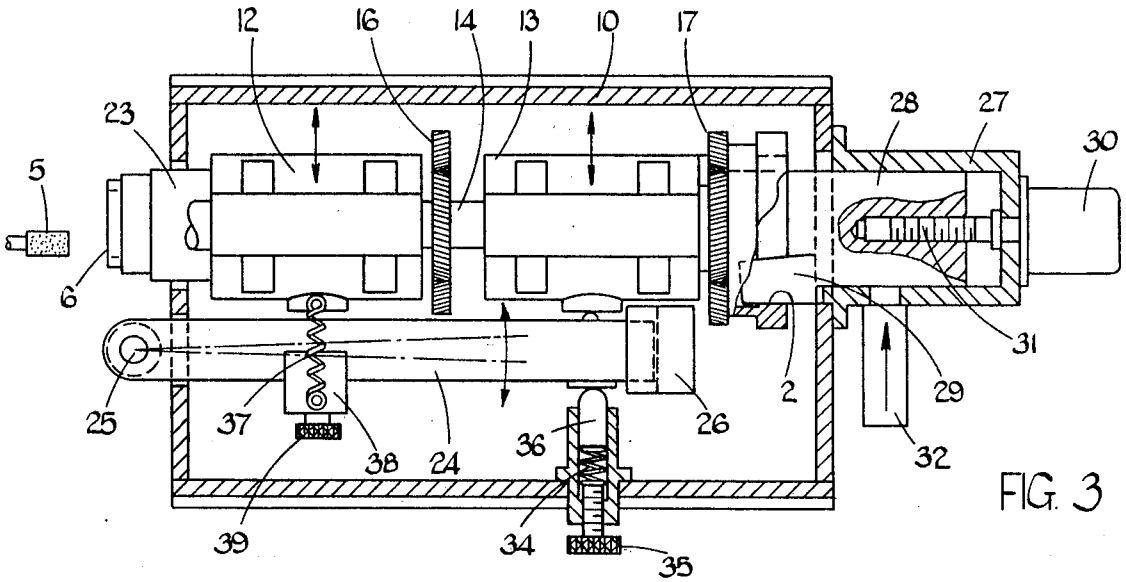
FIG. 3 is a section according to III—III in FIG. 2.
Figure 4:
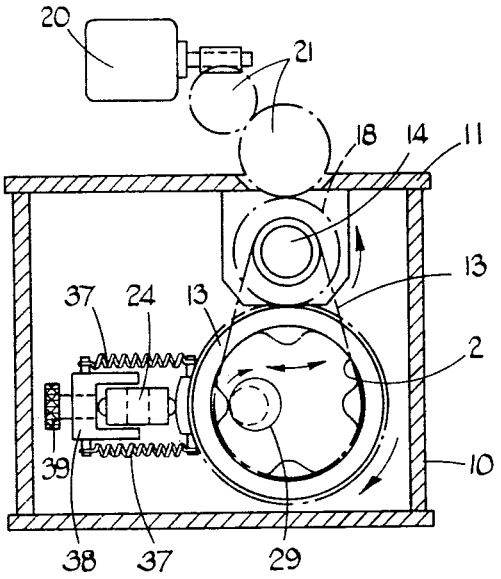
FIG. 4 is a section according to IV—IV in FIG. 2.

Reference is made to FIGS. 2 & 4, representing a grinding machine according to the invention. The machine comprises a frame 10 with a cover 11 within which are located two stocks 12, 13 each having rotary shafts. The tow stocks are movable about a common shaft 14 upon the respective arms 12' and 13'. The shaft 14 is carried by three ball bearing units 15 mounted in the frame.

The shafts of the stocks 12 and 13 are respectively integral with helically toothed pinions pinion 16 and 17, engaging respectively with toothed pinions 18, 19 integral with shaft 14, and the stocks 12 and 13 can move angularly about the shaft 14, whilst their respective shafts rotate about their own axes at the same rotational speed. The pinion 18 is driven by a variable speed motor 20 through a gear train 21 and a reducer 22, the assembly being mounted on the cover 11.

The shaft of the stock 12 is fitted with a support 23 for the component to be machined opposite which the grinding wheel 5 rotates. The shaft of the stock 13 supports the master component or generator profile 2. The stocks 12 and 13 are interconnected by means of a lever 24 articulated at one end on a shaft 25 and guided at the other end by a fork 26.

The rear of the frame 10 is bored to accommodate a barrel 27 in which a slide 28 is able to move parallel with the axis of the two stocks 12 and 13. The slide 28 carries a tapered roll 29 mounted on two ball bearings (not shown) so as to rolatable about its own axis, the axis of the roll 29 being slanted in relation to the axis of the stocks, according to an angle a (FIG. 5) so that the line of contact between the roll and master cam remains parallel with the axis of the two stocks. The slide 28 is driven to move under the thrust of a step-by-step programmed motor 30 driving a worm and nut assembly 31.

Between each movement of the slide 28 a hydraulic/-pneumatic pressure intensifier cylinder 32 locks the slide to eliminate any slide movement, a finger 33 indexing the taper roll to the centre of the generator profile 2 and maintaining it in that position during the slide movement 28. A spring 34 calibrated by a screw 35 threaded into the frame 1, exerts a thrust against a slide 36 bearing on the lever 24 and consequently upon the stock 13, so that the roll 29 is maintained against the generator profile. The stock 12 bears against the arm 24 under pressure from two springs 37 reacting on a caliper 38, a screw 39 ensuring the necessary adjustment.

When the shaft of the stock 13 is driven to rotate about its own axis and the profile 2 is maintained in engagement with the taper roll 29, the stock 13 oscillates about the shaft 14 and its oscillations are followed by the stock 12, the two movements being homothetic in relation to each other as a result of the lever 24. The machined component 6 is subject to a homothetic movement as related to the generator profile 2, because the shafts associated with the two stocks 12 and 13 rotate at the same speed.

Figure 5:
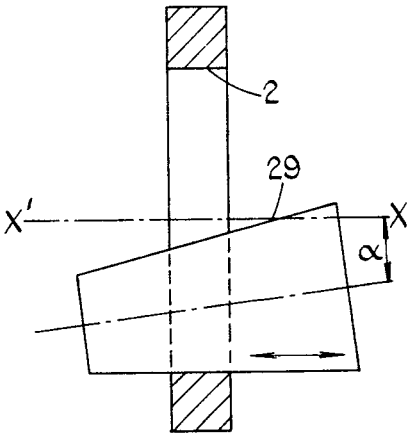
FIG. 5 is a section on a larger scale through a detector roll according to an invention design.

Reference is now made to FIG. 5 to explain the function of the taper roll 29 replacing the cylindrical roll 1 in FIG. 1. The taper roll 29 moveable parallel to axis X' X of the stock 13, so that its generating surface is parallel to axis X' X and the distance therebetween remains constant. Consequently, the amplitude of oscillation of the stock 13 remains constant, regardless of the relative axial position of the generator profile 2 and the taper roll 29, thus ensuring constant dimensions of the profile on the component to be machined. During the rotation of the generator profile 2, the contact point of the straight edge (in FIG. 5) on the taper roll 29, describes a curve on the roll which is located in a plane perpendicular to axis X' X, i.e. an ellipse. Within the limitations set by the generator profile 2 in the oscillation movement, this ellipse can be assimilated to a circle, providing angle X remains sufficiently small, so as to observe the tolerances imposed for reproduction purposes.

The operation of the machine is as outlined below. At the start of the cycle, the grinding-wheel 5 is rotating as is, the motor 20 driving the shafts of the stocks 12 and 13. The grinding-wheel 5 is engaged inside the component 6 to be machined, the grinding machine table on which the grinding head is mounted moves forward automatically and the grinding operation commences on the component 6. The oscillatory movement described takes place and the internal surface of the component approaches the form of the master cam.

Before achieving the final dimension, the grinding-wheel is withdrawn from the component and diamond-dressed to sharpen it and correct any geometrical defects. This consequently reduces its diameter.

The diamond dressing is controlled electrically by adjustment of the grinding machine. An electrical control signal is also sent to the head, and the following cycle is triggered: release of the slide 28 by backing off the oil hydraulic/pneumatic cylinder 32; start up of the step-by-step motor 30 which moves the slide 28 back to the rear, together with the taper roll 29, to maintain the grinding diameter ratio between the wheel and the roll; locking the slide 28 by advancing the oil hydraulic/-pneumatic cylinder 32; and reducing the rotation speed of the shafts of the stocks 12 and 13 by the intermediary of the variable speed motor 30 so as to reduce the inertia of the stocks in their oscillatory movement, thereby to obtain a more accurate profile reproduction.

Having effected these operations, the grinding-wheel 5 is engaged once more inside the component 6 to be machined and grinding proceeds until the finishing dimension is obtained.

On triggering the cycle for the next component, the motor 20 is programmed to return to its original speed. The cycles continue successively until the grinding-wheel is fully worn.

At each grinding-wheel change, and for a given number of components, the step-by-step motor 30 is adjusted to bring back the slide 28 and the roll 29 in such a manner as to achieve the required ratio between the diameter of the new grinding-wheel and that of the taper roll.

Figure 6:
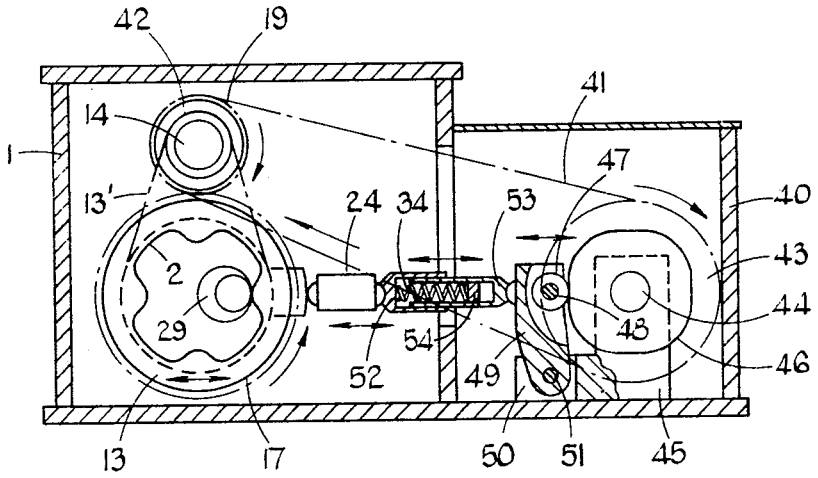
FIG. 6 is a section through part of the machine in FIG. 2, as relating to a different design.

In the design illustrated in FIG. 6, the head is fitted with means for balancing the inertia of stock 13 during its oscillatory movement. The pressure between the roll 29 and the profile 2 is in fact due to the thrust of the spring 34 and to the inertia of stock 13. It is desirable to achieve a pressure which is essentially constant, whereas the pressure of the spring alone and that due to inertia may vary independently according to the relative position of the taper roll and the master cam. For that purpose, the invention provides for means for varying the force exerted by the spring 34.

The adjustment arrangement is located in a housing 40 on the side of the frame 1. A chain 41 connects two wheels 42 and 43 having the same ratio as pinions 19 and 17. The drive wheel 42 is mounted on the shaft 14 and drives by means of the chain 41 the wheel 43 mounted on a shaft 44 supported on a mounting 45. The shaft 44 carries a cam 46, the assembly consisting of wheel 43, shaft 44 and cam 46 being integral.

A roller 47 rotates about a shaft 48, the said shaft 48 being mounted on a lever 49 articulated on a bracket 50 by means of a shaft 51. The rollers 47 rolls on the profile of the cam 46. The spring 34 is mounted in two closed-end telescopic members 52 and 53 and can be adjusted by means of a screw 54 without changing the distance between the closed ends of members 52 and 53, the members being interposed between lever 49 and lever 24. The cam profile 46 is selected so as to maintain a substantially constant overall pressure between the roller 29 and the profile 2, in accordance with the shape of the profile.

I claim:

1. An attachment for a grinding machine having a movable work table and a rotary grinding wheel rotatable about a first axis the attachment comprising a support frame for mounting on said table, first means carried by the support frame for holding a component upon an internal peripheral surface of which a profile is to be machined, said first means rotating said component about a second axis parallel to the axis of rotation of said grinding wheel, second means carried by the support frame for holding a master having an internal profile corresponding to the desired profile of the component, said second means rotating said master about an axis coincident with said second axis, a detector roll engageable with the internal profile of said master, said detector roll being of varying diameter throughout its axial length, mounting means for said detector roll, said mounting means being arranged to permit rotation of said roll about a third axis inclined relative to the second axis by an amount such that the line of contact between the roll and said internal profile extends paralled to said second axis, connecting means for transmitting movement between said first and second means whereby homothetic motion will be imparted to said first means as a result of movement of said second means by the interaction of the roll and the internal profile of the master, said mounting means being adjustable so that when the diameter of said grinding wheel is changed as a result of dressing or changing the wheel the homothetic relationship of the motion of the grinding wheel and the detector roll is maintained.

2. An attachment according to claim 1 in which said first and second means comprise stocks respectively, each of said stocks mounting a rotary shaft upon which is carried the workpiece and the master respectively, mounting means mounting said stocks for pivotal movement about a common axis and drive means for driving said shafts at the same rotational speed.

3. An attachment according to claim 2 in which said connecting means comprises a lever pivotally mounted on said support frame and resilient means biasing said lever into engagement with said stocks.

4. An attachment according to claim 3 in which said resilient means comprises first spring means acting intermediate the lever and the casing at a position removed along the length of the lever from the pivot of the lever, said first spring means also acting to maintain contact between said internal profile and said detector roll and said resilient means including second spring means acting between the lever and the stock forming said first means at a position on the lever intermediate said first mentioned position and said pivot.

5. An attachment according to claim 4 including a drive shaft, gearing coupling the shaft of said stocks independently to said drive shaft, said common axis being defined by the axis of said drive shaft.

6. An attachment according to claim 5 including arms supporting the stocks and bearings mounting said arms for pivotal movement about said drive shaft.

7. An attachment according to claim 6 including adjustable means for adjusting the force exerted by said first spring means.

8. An attachment according to claim 7 in which said adjustable means includes a rotary cam, means for driving said cam, a roller engaging said cam and means coupling said roller and said first spring means, said cam being shaped so that the force exerted on the detector roll is maintained substantially constant.

9. An attachment according to claim 1, wherein said mounting means for said detector roll comprises a tubular band, a sleeve slidably retained in said band for supporting at one end said detector roll for rotatable movement about the third axis, and means for moving said sleeve axially parallel to the second axis.

10. An attachment according to claim 9 including means for locking said sleeve against axial movement after adjustment and during operation of said grinding machine.

* * * * *